US007792482B2

(12) United States Patent
Walker et al.

(10) Patent No.: US 7,792,482 B2
(45) Date of Patent: Sep. 7, 2010

(54) COMMUNICATION SERVICE SUBSCRIPTION MANAGEMENT

(75) Inventors: Glenn A. Walker, Greentown, IN (US); Joseph R. Dockemeyer, Jr., Kokomo, IN (US); Michael L. Hiatt, Jr., Westfield, IN (US); Harry Diamond, Tipton, IN (US); Linda L. Miner, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 754 days.

(21) Appl. No.: 11/713,547

(22) Filed: Mar. 2, 2007

(65) Prior Publication Data

US 2008/0214100 A1 Sep. 4, 2008

(51) Int. Cl.
*H04H 1/00* (2006.01)

(52) U.S. Cl. ..... 455/3.02; 455/3.05; 455/435.1

(58) Field of Classification Search ..... 455/3.02, 455/3.05, 410, 412.1, 420, 421, 435.1, 456.1, 455/456.3, 41.2, 514, 345, 352
See application file for complete search history.

(56) References Cited

U.S. PATENT DOCUMENTS 6,490,443 B1 * 12/2002 Freeny, Jr. ..... 455/406
7,107,322 B1 * 9/2006 Freeny, Jr. ..... 709/217
2004/0114036 A1 * 6/2004 Karaoguz et al. ..... 348/142
2004/0203895 A1 * 10/2004 Balasuriya ..... 455/456.1
2005/0266798 A1 * 12/2005 Moloney et al. ..... 455/41.2
2006/0047722 A1 * 3/2006 Walker et al. ..... 707/204
2007/0060045 A1 * 3/2007 Prautzsch ..... 455/3.06
2007/0268911 A1 * 11/2007 Alve ..... 370/395.52

* cited by examiner

*Primary Examiner*—Sujatha Sharma
(74) *Attorney, Agent, or Firm*—Jimmy L. Funke

(57) ABSTRACT

Multiple receivers may be enabled to receive satellite-based digital audio radio (SDAR) services under a single subscription. For example, an SDAR service provider can enable multiple vehicles, a home-based digital radio, or a portable digital radio, singly or in any combination. Multiple receivers transmit information to each other. One receiver is designated as a primary receiver, and the other receivers are designated as secondary receivers. The SDAR service provider transmits a list of associated secondary receivers to the primary receiver. The primary receiver enables the associated secondary receivers to receive SDAR services by placing them in an authorized state. The secondary receivers must periodically communicate with the primary receiver to remain authorized. A secondary receiver that fails to communicate with the primary receiver within a prescribed time period is switched to an unauthorized state. In this unauthorized state, the secondary receiver no longer performs as an authorized receiver.

34 Claims, 4 Drawing Sheets

COMMUNICATION SERVICE SUBSCRIPTION MANAGEMENT

TECHNICAL BACKGROUND

The present invention relates generally to communication services. More particularly, the present invention relates to managing subscriptions to communication services.

BACKGROUND OF THE INVENTION

The vast majority of vehicles currently in use incorporate vehicle communication systems for receiving or transmitting signals. For example, vehicle audio systems provide information and entertainment to many motorists daily. These audio systems typically include an AM/FM radio receiver that receives radio frequency (RF) signals. These RF signals are then processed and rendered as audio output.

Some vehicle audio systems are configured to take advantage of satellite-based digital audio radio (SDAR) services that offer digital radio service covering a large geographic area, such as North America. By contrast, AM and FM broadcast radio signals can reach a relatively limited geographic area, such as a metropolitan area. SDAR service providers typically transmit digital radio service via either geosynchronous orbit satellites or highly elliptical orbit satellites that receive uplinked programming. These satellites broadcast the programming directly to digital radios that subscribe to the service. Subscribing digital radios are typically located in vehicles, but can also be located in homes and other fixed locations. In addition, some subscribing digital radios are portable units that can be used by subscribers during such activities as exercising. SDAR systems typically employ terrestrial, or ground-based, repeaters in addition to satellite-based transmitters to provide a clean and uninterrupted radio signal broadcast in certain areas susceptible to satellite signal blockage. Each vehicle subscribing to the digital service generally includes a digital radio having a receiver and a pair of antennas for receiving the satellite and terrestrial signal broadcasts.

While not required, SDAR service providers typically operate on a paid subscription-based paradigm. Some subscribers have multiple devices, for example, installed in multiple vehicles. Additional devices may also be located, for instance, in houses. Without a way to provide multiple subscriptions for a subscriber, such subscribers would be required to purchase a subscription for each device. Many subscribers would find this requirement objectionable. Accordingly, SDAR service providers that can enable the use of multiple devices for a single subscriber account may be particularly attractive to consumers and may benefit from an increased number of subscriptions. On the other hand, this capability is susceptible to abuse. Some subscribers may enable multiple devices under a single account and subsequently distribute the devices to others. For example, some subscribers may enable several vehicle-based digital radios and then sell the vehicles to others.

SUMMARY OF THE INVENTION

According to various example embodiments of the present invention, a satellite-based digital audio radio (SDAR) service provider may enable multiple receivers to receive SDAR services under a single subscription. For example, an SDAR service provider can enable multiple vehicles, a home-based digital radio, or a portable digital radio, singly or in any combination. Multiple receivers transmit information to each other. One receiver is designated as a primary receiver, and the other receivers are designated as secondary receivers. The SDAR service provider transmits a list of associated secondary receivers to the primary receiver. The primary receiver enables the associated secondary receivers to receive SDAR services by placing them in an authorized state. The secondary receivers must periodically communicate with the primary receiver to remain authorized. A secondary receiver that fails to communicate with the primary receiver within a prescribed time period is switched to an unauthorized state. In this unauthorized state, the secondary receiver no longer performs as an authorized receiver.

In one embodiment, a secondary communication device is enabled to receive communication services by determining whether the secondary communication device is within a threshold proximity to a primary communication device. If the secondary communication device is within the threshold proximity to the primary communication device, an authorized operational mode is set. If, on the other hand, the secondary communication device is outside the threshold proximity to the primary communication device for a threshold duration, an unauthorized operational mode is set.

Another embodiment is directed to a method for setting an operational mode of a communication device in an SDAR system. The communication device receives control information from an SDAR service provider. Based on this control information, the communication device is assigned a primary communication device status or a secondary communication device status. When the primary communication device status is assigned, the communication device is set to an authorized operational mode. The authorized operational mode is also set when the secondary communication device status is assigned and the communication device is within a threshold proximity to a primary communication device. When the secondary communication device status is assigned and the communication device is outside the threshold proximity to the primary communication device for a threshold duration, an unauthorized operational mode is set. The above methods may be embodied in processor-readable media.

In another embodiment, a communication device operable in a satellite-based digital audio radio (SDAR) system includes an antenna configured to receive a signal from an SDAR service provider. A decoder subsystem is operatively coupled to the antenna and is configured to generate a control signal as a function of the received signal. An authorization subsystem is operatively coupled to the antenna and is configured to assign to the communication device either a primary communication device status or a secondary communication device status as a function of the control signal. When the primary communication device status is assigned, the authorization subsystem also sets an authorized operational mode. The authorized operational mode is also set when the secondary communication device status is assigned and the communication device is within a threshold proximity to a primary communication device. The authorization subsystem sets an unauthorized operational mode when the secondary communication device status is assigned and the communication device is outside the threshold proximity to the primary communication device for a threshold duration.

Various embodiments of the present invention may provide certain advantages. Authorizing a secondary communication device to receive SDAR services based on proximity to a primary communication device facilitates offering multiple subscriptions on a single subscriber account. Further, requiring any secondary communication devices to periodically confirm that they are still within the threshold proximity to the primary communication device to remain authorized may decrease the likelihood of abuse. In particular, this requirement may help ensure that multiple communication devices subscribed under a single subscriber account are in fact being used within a single family or household.

Additional objects, advantages, and features of the present invention will become apparent from the following description and the claims that follow, considered in conjunction with the accompanying drawings.

BRIEF DESCRIPTION OF THE DRAWINGS

The present invention will now be described, by way of example, with reference to the accompanying drawings, in which.

DESCRIPTION OF PREFERRED EMBODIMENTS

Figure 1:
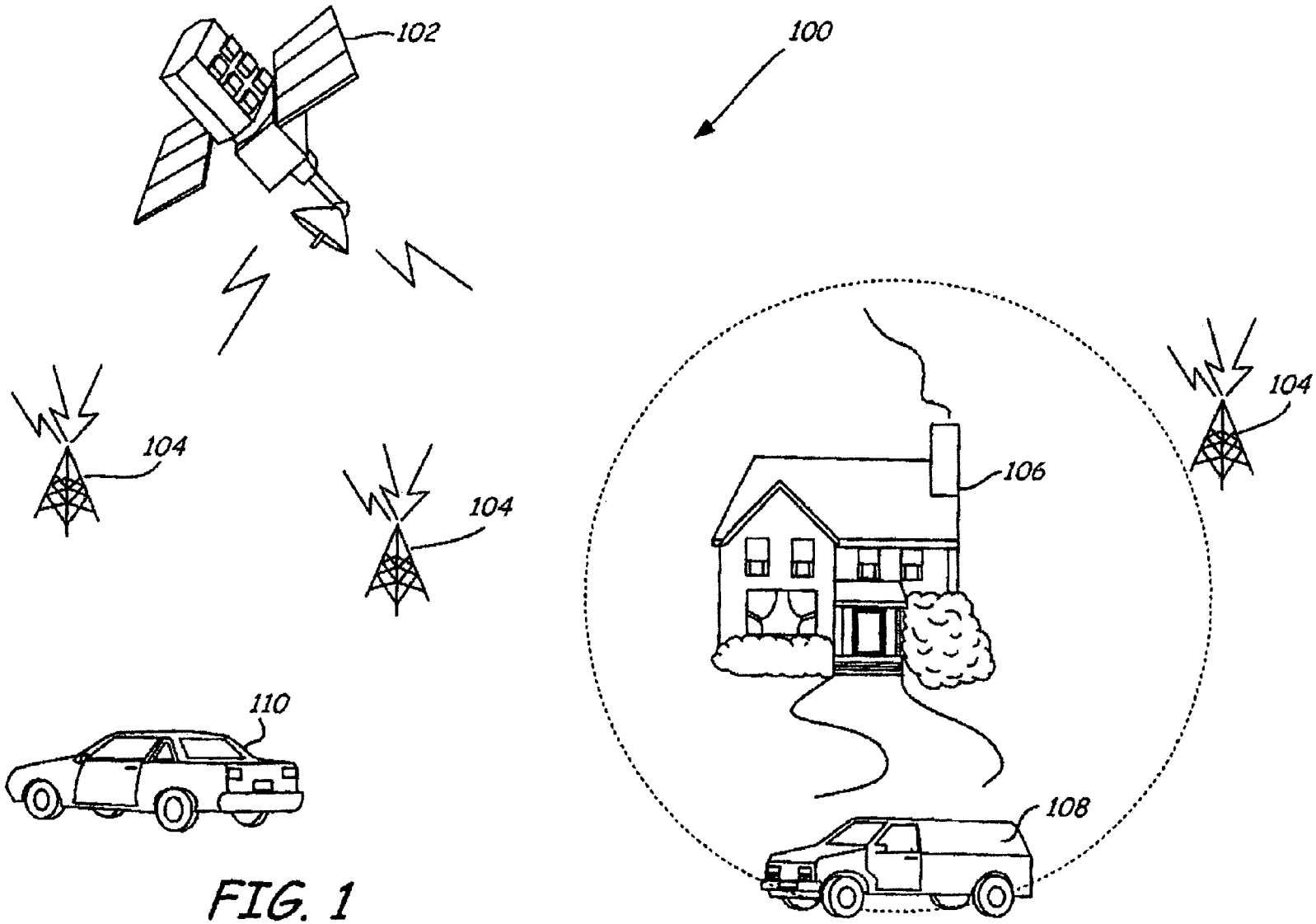
FIG. 1 illustrates an example satellite-based digital audio radio (SDAR) system, according to an embodiment of the invention.

Various embodiments of the present invention facilitate enabling multiple communication devices, such as receivers, to receive communication services, e.g., satellite-based digital audio radio (SDAR) services, under a single subscription. For example, an SDAR service provider can enable multiple vehicles, a home-based digital radio, or a portable digital radio, singly or in any combination. Multiple receivers transmit information to each other using a wireless or wired communication link or a removable data storage medium, such as a flash memory device. One receiver is designated as a primary receiver, and the other receivers are designated as secondary receivers. The SDAR service provider transmits a list of associated secondary receivers to the primary receiver. The primary receiver keeps track of the associated secondary receivers and enables them to receive SDAR services by placing them in an authorized state. The secondary receivers must periodically communicate with the primary receiver to remain authorized. If a secondary receiver fails to communicate with the primary receiver within a time period prescribed, for example, by the SDAR service provider, that secondary receiver is switched to an unauthorized state. In this unauthorized state, the secondary receiver will no longer perform as an authorized receiver.

Authorizing a secondary communication device to receive SDAR services based on proximity to a primary communication device facilitates offering multiple subscriptions on a single subscriber account. Further, requiring any secondary communication devices to periodically confirm that they are still within the threshold proximity to the primary communication device to remain authorized may decrease the likelihood of abuse. In particular, this requirement may help ensure that multiple communication devices subscribed under a single subscriber account are in fact being used within a single family or household.

The following description of various embodiments implemented in a vehicle-based SDAR device is to be construed by way of illustration rather than limitation. This description is not intended to limit the invention or its applications or uses. For example, while various embodiments of the invention are described as being implemented in vehicle-based SDAR device, it will be appreciated that the principles of the invention are applicable to SDAR devices operable in other environments. For example, as described below, a home-based SDAR device often serves as a primary communication device, with one or more vehicle-based SDAR devices serving as secondary communication devices. In addition, portable SDAR devices can be enabled or authorized in much the same way as vehicle-based SDAR devices.

In the following description, numerous specific details are set forth in order to provide a thorough understanding of various embodiments of the present invention. It will be apparent to one skilled in the art that the present invention may be practiced without some or all of these specific details. In other instances, well known components and process steps have not been described in detail in order to avoid unnecessarily obscuring the present invention.

The invention may be described in the general context of processor-executable instructions, such as program modules, being executed by a processor. Generally, program modules include routines, programs, objects, components, data structures, etc., that perform particular tasks or implement particular abstract data types. The invention may also be practiced in distributed processing environments in which tasks are performed by remote processing devices that are linked through a communications network or other data transmission medium. In a distributed processing environment, program modules and other data may be located in both local and remote storage media, including memory storage devices.

Referring now to the drawings, FIG. 1 illustrates an example SDAR system 100 in which a satellite 102 in geosynchronous or highly elliptical orbit around the Earth broadcasts radio frequency (RF) signals via one or more satellite-based transmitters. One or more ground-based, or terrestrial, repeaters 104 may rebroadcast the RF signals received from the satellite 102 to reach areas not covered by the satellite 102 itself, e.g., tunnels and other enclosed areas.

A subscriber to SDAR services may have multiple receivers. For example, the subscriber may have one receiver located in a house 106, another receiver located in a vehicle 108, and still another receiver located in another vehicle 110. When the subscriber creates an account with the SDAR service provider, the SDAR service provider designates one of the receivers as a primary or master receiver. In the example shown in FIG. 1, the receiver located in the house 106 is designated as the primary receiver. The other receivers, e.g., the receivers located in the vehicles 108 and 110, are designated as secondary or slave receivers.

To allow the subscriber to receive SDAR services on multiple communication devices, e.g., the receiver located in the house 106 and the receivers located in the vehicles 108 and 110, the primary receiver enables or authorizes the secondary receiver or receivers as long as certain proximity criteria are satisfied. The primary receiver can determine whether the proximity criteria are met using, for example, a wireless communication link to the secondary receivers. This wireless communication link can be established using any of a variety of conventional wireless communication protocols, including, but not limited to, the Bluetooth, ZigBee, ultra wideband (UWB), and IEEE communication protocols, including 802.11a, 802.11b, 802.11g, 802.16, and 802.20. All of these example wireless communication protocols provide secure data communication. As the amount of data communicated between the primary and secondary receivers is relatively small, the data transmission rate of the communication link is not an important consideration.

The primary receiver, i.e., the receiver located in the house 106, can communicate with the secondary receivers using the wireless communication link over a range indicated by the dashed line in FIG. 1. The receiver located in the house 106 periodically attempts to establish wireless communication with its associated secondary receivers, namely, the receivers located in the vehicles 108 and 110.

If the primary receiver successfully establishes wireless communication with a particular secondary receiver, that secondary receiver can be inferred to be within a threshold proximity to the primary receiver. On the other hand, if the primary receiver fails to establish wireless communication with a particular secondary receiver, that secondary receiver can be inferred to be outside the threshold proximity.

To ensure that the primary and secondary receivers are in fact being used within the same household and thereby reduce the risk of subscription abuse, the secondary receivers act as authorized devices only when they are within the threshold proximity to the primary receiver for a prescribed amount of time. By way of example, if a secondary receiver leaves the threshold proximity to the primary receiver, a countdown timer may be started. If the secondary receiver enters the threshold proximity to the primary receiver, the countdown timer may be stopped and reset. If the countdown timer expires without being stopped and reset, it can be inferred that the secondary receiver was outside the threshold proximity to the primary receiver for longer than a threshold duration. Accordingly, the secondary receiver operates as an unauthorized device until it is re-authorized by entering the threshold proximity to the primary receiver. An unauthorized device is not necessarily completely disabled. Rather, an unauthorized device may, at the option of the SDAR service provider, receive a limited subset of services. For example, while not required, the SDAR service provider may still send text messages or control information to an unauthorized device, while denying access to audio programming.

As shown in FIG. 1, the vehicle 108 is within the threshold proximity to the house 106. As long as the vehicle 108 is within the threshold proximity, the receiver located in the vehicle 108 operates as an authorized device. By contrast, the vehicle 110 has left the threshold proximity to the house 106. The receiver located in the vehicle 110 may remain authorized, provided that the vehicle 110 returns to the threshold proximity to the house 106 often enough to satisfy the proximity criteria. For example, the SDAR service provider may specify that a secondary receiver may remain authorized as long as it is within the threshold proximity to the primary receiver at least once every 24 hours. Accordingly, if the vehicle 110 is used to commute to work every day, the receiver located in the vehicle 110 will remain authorized as long as the vehicle parks at the house 106 sufficiently often. If, however, the vehicle 110 is sold and permanently removed from the threshold proximity to the house 106, the receiver located in the vehicle 110 will eventually become unauthorized.

While not required, the threshold duration required for an authorized secondary device to become unauthorized can be adjusted automatically or by the SDAR service provider. For example, if the vehicle 108 is within the threshold proximity of the house 106 at least once every 24 hours for 30 continuous days, the threshold duration may be lengthened to, for example, a week. With the threshold duration thus lengthened, the receiver located in the vehicle 108 will not become unauthorized if the vehicle 108 leaves the threshold proximity to the house 106 for two or three days at a time.

In some implementations, the wireless communication link can be used to switch the status of a receiver from primary to secondary or vice versa. For example, a subscriber may temporarily designate the receiver located in the vehicle 108 as the primary receiver while the subscriber is on vacation. The other receivers, i.e., the receiver located in the vehicle 110 and the receiver located in the house 106, would be designated as secondary receivers. This temporary reassignment of primary and secondary roles can be reset to the default configuration either automatically after a predetermined duration or on the initiative of the subscriber.

The above discussion of FIG. 1 assumes that the primary and secondary receivers communicate with each other using a wireless communication link. However, the primary receiver can authorize the secondary receivers in other ways. For example, the primary receiver can communicate with the secondary receiver using a wired communication link. While this implementation is impractical for receivers in different vehicles for obvious reasons, it may be used to authorize a secondary receiver located in the same vehicle as the primary receiver, e.g., a rear seat entertainment system.

As another example, a primary communication device can authorize secondary devices by storing authorization information on a removable memory device, such as a flash memory device. The secondary device then retrieves the authorization information from the removable memory device. This implementation may be particularly advantageous for operational environments in which the secondary device is expected to be outside the threshold proximity to the primary device for extended durations. For example, a car rental agency may have a primary communication device installed at a base location. The primary communication device can be used in this way to authorize secondary devices installed in rental cars.

Figure 2:
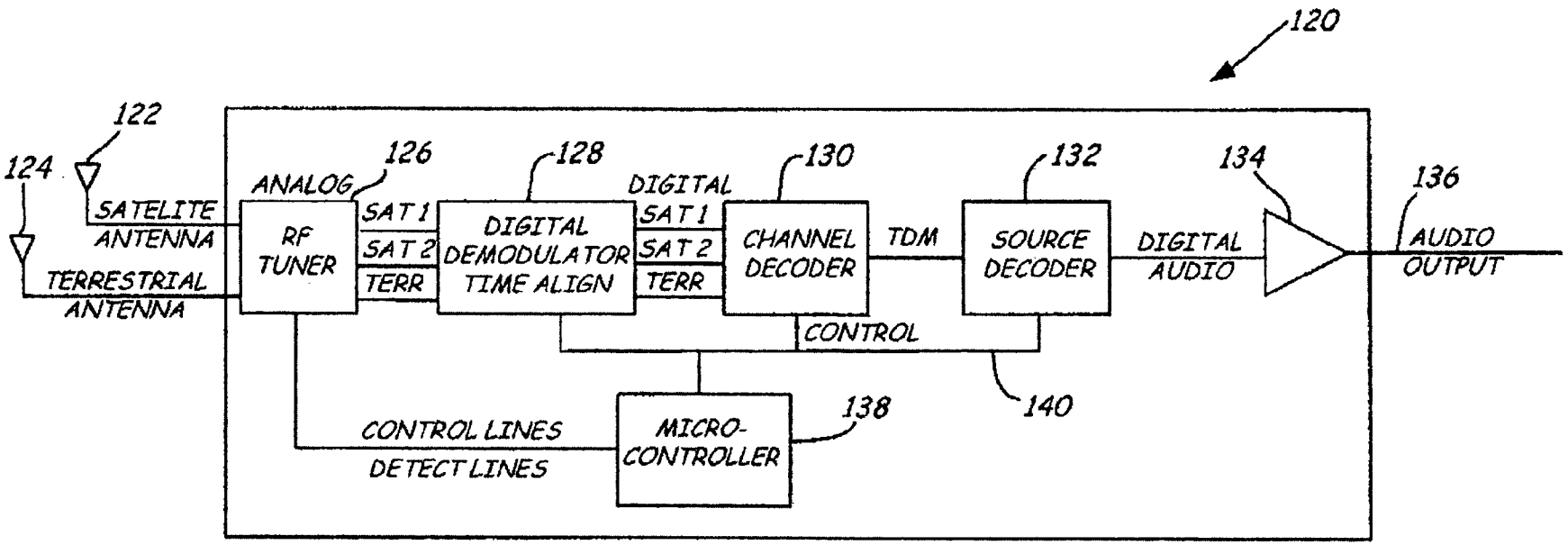
FIG. 2 is a block diagram illustrating an example SDAR receiver according to another embodiment of the invention.

FIG. 2 is a block diagram illustrating an example SDAR receiver 120 according to another embodiment of the invention. The SDAR receiver 120 is associated with a satellite antenna 122 for receiving RF signals broadcast by the satellite 102. In addition, the SDAR receiver 120 may also be associated with a terrestrial antenna 124 for receiving RF signals broadcast by the terrestrial repeaters 104. At any given time, either the satellite antenna 122 or the terrestrial antenna 124 provides a primary signal path, and the other antenna provides a secondary signal path. While not shown in FIG. 2, the SDAR receiver 120 may also have additional antennas that provide additional signal paths. Further, a variable gain circuit controlled by an offset circuit may be used to optimize the performance of the SDAR receiver 120. The variable gain circuit and the offset circuit are well known components and have not been described in detail in order to avoid unnecessarily obscuring the present invention.

The SDAR receiver 120 is configured to receive, decrypt, and decode digital data signals received via the satellite antenna 122 and the terrestrial antenna 124. An RF tuner 126 has antenna inputs for receiving RF signals received by each of the satellite antenna 122 and the terrestrial antenna 124. The RF tuner 126 selects a frequency bandwidth or channel of digital audio and/or data to pass each of the RF signals (SAT1, SAT2, and TERR) within a tuned frequency bandwidth. The SDAR receiver 120 also includes a digital demodulator 128 that receives analog signals output by the RF tuner 126 and generates demodulated digital signals (SAT1, SAT2, and TERR). The digital demodulator 128 may include a signal quality monitor (not shown) that monitors the signal quality of each channel. The signal quality monitor may monitor, for example, the bit error rate (BER) and/or the signal-to-noise ratio (S/N) of the digital signals. The SDAR receiver 120 also includes a channel decoder 130 that creates a time division multiplexed (TDM) data stream and a source decoder 132 that selects desired information contained within the TDM data stream. This information may include audio information, control and other data, or both. The selected information is passed to a digital-to-analog converter (DAC) 134 that generates an analog output signal at an output 136. The SDAR receiver 120 also includes a microcontroller 138 for communicating with the RF tuner 126, the digital demodulator 128, the channel decoder 130, and the source decoder 132 via a data communication bus 140 or other communication path.

The microcontroller 138 is typically configured to operate with one or more types of processor readable media. Processor readable media can be any available media that can be accessed by the microcontroller 138 and includes both volatile and nonvolatile media, removable and non-removable media. By way of example, and not limitation, processor readable media may include storage media and communication media. Storage media includes both volatile and nonvolatile, removable and nonremovable media implemented in any method or technology for storage of information such as processor-readable instructions, data structures, program modules, or other data. Storage media includes, but is not limited to, RAM, ROM, EEPROM, flash memory or other memory technology, CD-ROM, digital versatile discs (DVDs) or other optical disc storage, magnetic cassettes, magnetic tape, magnetic disk storage or other magnetic storage devices, or any other medium that can be used to store the desired information and that can be accessed by the microcontroller 138. Communication media typically embodies processor-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above are also intended to be included within the scope of processor-readable media.

Figure 3:
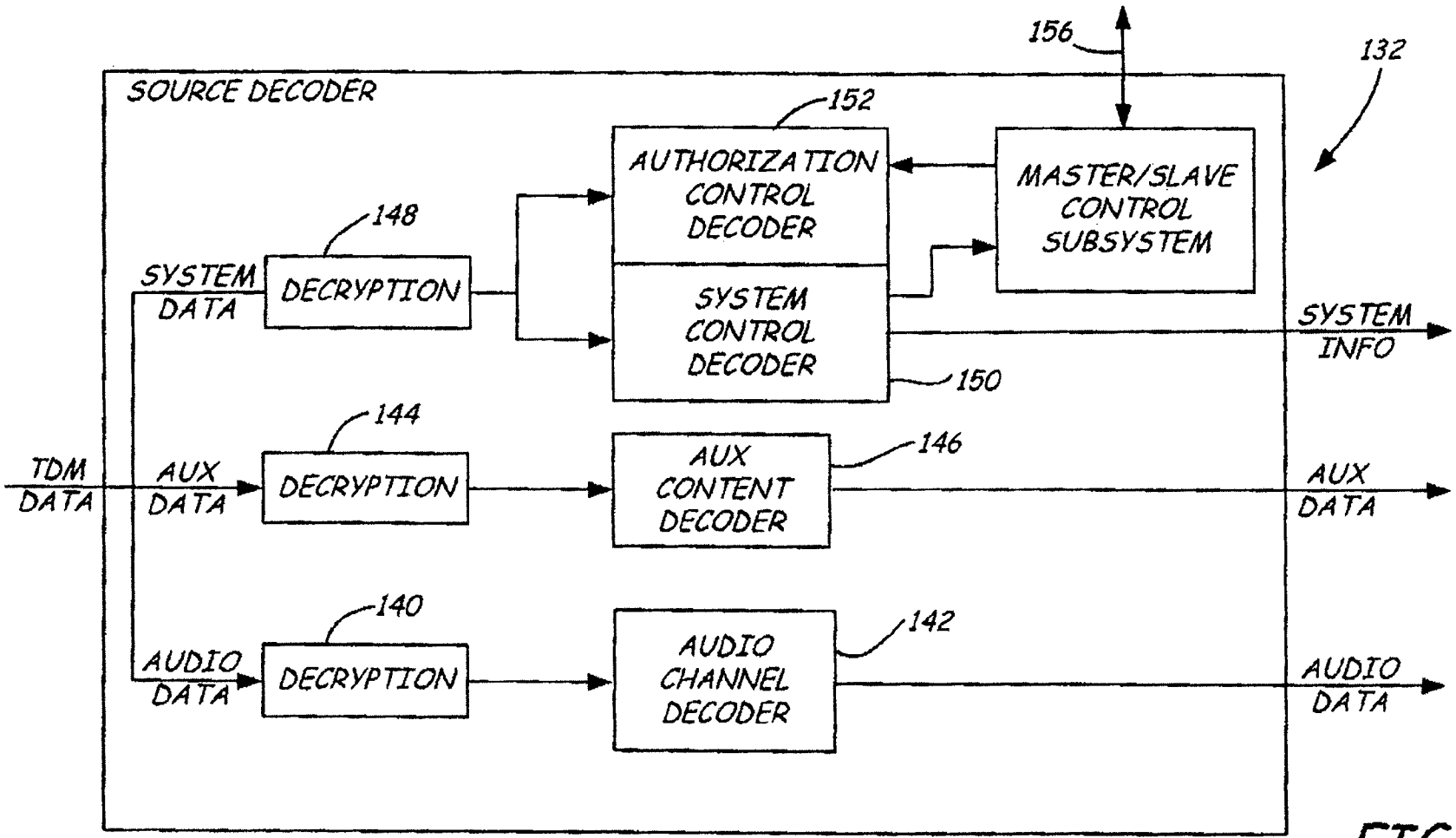
FIG. 3 is a block diagram illustrating an example decoder subsystem forming part of the SDAR receiver of FIG. 2, according to yet another embodiment of the invention.

The source decoder 132 incorporates control circuitry, illustrated in greater detail in FIG. 3, that assigns a primary communication device status or a secondary communication device status to the receiver 120 based on control information received by the satellite antenna 122, the terrestrial antenna 124, or both. If the primary communication device status is assigned, the source decoder 132 also assigns an authorized status to the receiver 120. When the authorized status is assigned, the receiver 120 can access a full set of SDAR services, including audio and data services.

When the source decoder 132 assigns the secondary communication device status, the source decoder 132 determines whether certain proximity criteria specified by the SDAR service provider are satisfied. These criteria may include, for example, being within wireless communication range of an associated primary communication device for at least a minimum duration or frequency within a specified time period. For example, the SDAR service provider may specify that a secondary communication device must be within wireless communication range of its associated primary communication device at least four times a week. As described above in connection with FIG. 1, the primary communication device can determine whether the proximity criteria are met using, for example, a wireless communication link to the secondary communication device. This wireless communication link can be established using any of a variety of conventional wireless communication protocols, including, but not limited to, the Bluetooth, ZigBee, ultra wideband (UWB), and IEEE communication protocols, including 802.11a, 802.11b, 802.11g, 802.16, and 802.20.

If the proximity criteria are met, the source decoder 132 assigns an authorized status to the receiver 120, and the receiver 120 can access the full range of SDAR services. On the other hand, if the proximity criteria are not met, the source decoder 132 assigns an unauthorized status to the receiver 120. The receiver 120 then operates as an unauthorized device until it is re-authorized by entering the threshold proximity to its associated primary receiver. An unauthorized device is not necessarily completely disabled. Rather, an unauthorized device may, at the option of the SDAR service provider, receive a limited subset of services, such as text messages.

FIG. 3 is a block diagram illustrating an example implementation of the source decoder 132. The source decoder 132 receives a TDM data stream from the channel decoder 130 of FIG. 2. The TDM data stream includes system data, such as control information, audio data, and auxiliary data. Audio decryption circuitry 140 decrypts the audio data. An audio channel decoder 142 then decodes the decrypted audio data to the digital-to-audio converter 134 of FIG. 2. The auxiliary data is decrypted by decryption circuitry 144. An auxiliary content decoder 146 then decodes the decrypted auxiliary data. The decoded auxiliary content may contain, for example, text messages to be displayed by the SDAR receiver 120.

System data decryption circuitry 148 decrypts the control information and other system data. The control information may include system control information and authorization control information. System control decoder circuitry 150 decodes the system control information, and authorization control decoder circuitry 152 decodes the authorization control information. The authorization control information includes information for designating the SDAR receiver 120 as either a primary, or master, device or a secondary, or slave, device.

A master/slave control subsystem 154 receives the decoded system control information and authorization control information. Based on the system control information and the authorization control information, the master/slave control subsystem 154 assigns either a primary (master) communication device status or a secondary (slave) communication device status to the SDAR receiver 120.

When the primary communication device status is assigned, the master/slave control subsystem 154 also assigns an authorized status to the SDAR receiver 120. The SDAR receiver 120 then attempts to establish a wireless communication link with its associated secondary communication devices, as specified in the authorization control information. The SDAR receiver 120 may establish the wireless communication link via a wireless communication port 156 using any of a variety of conventional secure wireless communication protocols, including, but not limited to, the Bluetooth, ZigBee, ultra wideband (UWB), and IEEE communication protocols, including 802.11a, 802.11b, 802.11g, 802.16, and 802.20.

When the secondary communication device status is assigned, the master/slave control subsystem 154 assigns the authorized status to the SDAR receiver 120 if the SDAR receiver 120 is within the threshold proximity to its associated primary communication device. If the SDAR receiver 120 leaves this threshold proximity for longer than a threshold duration, the master/slave control subsystem 154 assigns an unauthorized status to the SDAR receiver 120. The duration for which the SDAR receiver 120 is outside the threshold proximity may be measured, for example, using a countdown timer. If the SDAR receiver 120 leaves the threshold proximity to the primary communication device, the countdown timer may be started. If the SDAR receiver 120 enters the threshold proximity to the primary communication device, the countdown timer may be stopped and reset. If the countdown timer expires without being stopped and reset, it can be inferred that the secondary receiver was outside the threshold proximity to the primary communication device for longer than the threshold duration. The SDAR receiver 120 then becomes an unauthorized device and can access at most a limited subset of SDAR services, such as text messaging.

Figure 4:
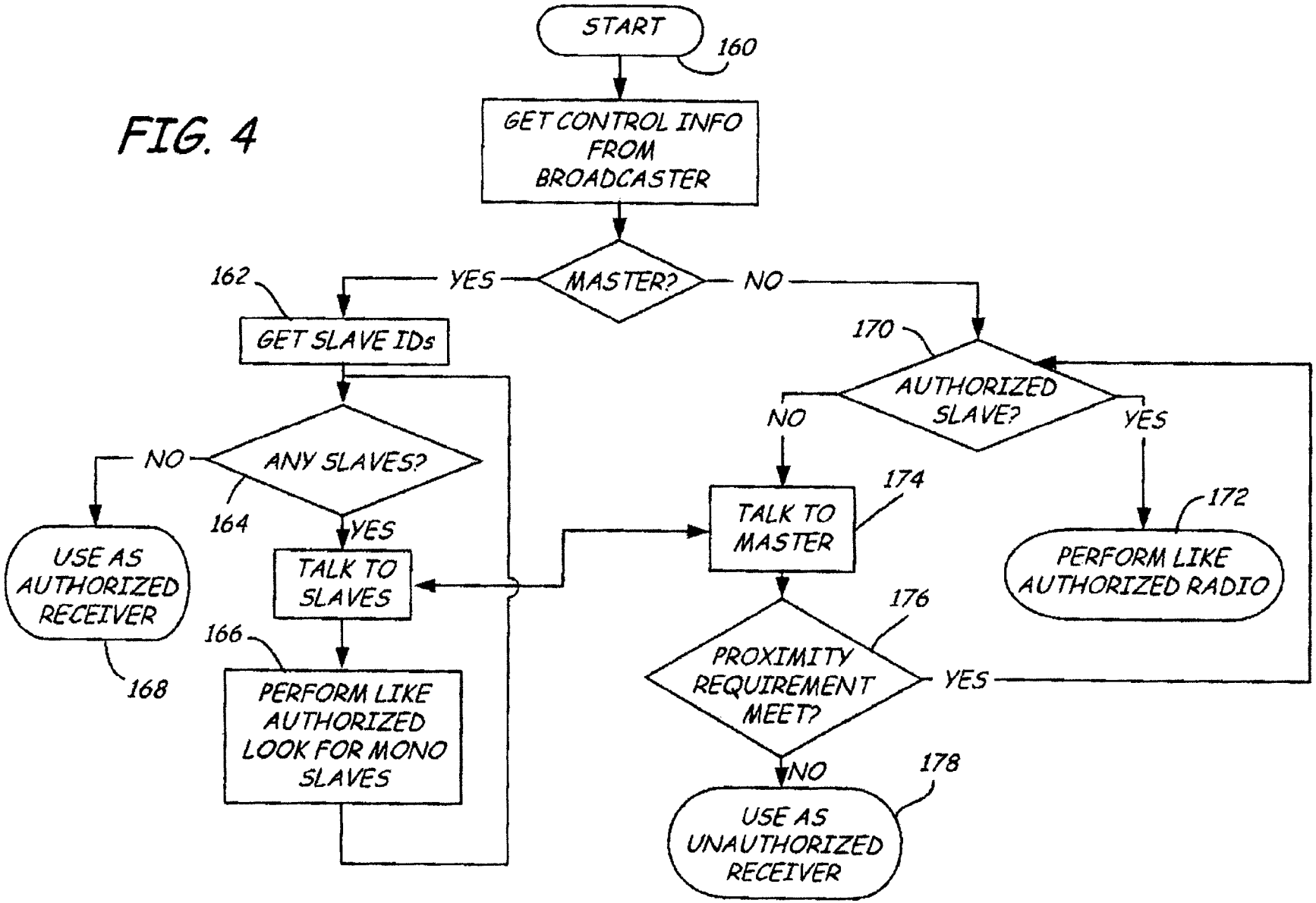
FIG. 4 is a flow diagram illustrating an example method for setting an operational mode of a communication device in an SDAR system, according to still another embodiment of the invention.

FIG. 4 is a flow diagram illustrating an example method for setting an operational mode of the SDAR receiver 120. As described above in connection with FIG. 3, the master/slave control subsystem 154 receives control information, such as system control information and authorization control information, from the SDAR service provider (160). Based on the control information, the master/slave control subsystem 154 determines whether the SDAR receiver 120 is a primary (master) receiver or a secondary (slave) receiver and assigns an appropriate status to the SDAR receiver 120.

If the SDAR receiver 120 is a master receiver, the master/slave control subsystem 154 receives data that identifies the slave receivers associated with the SDAR receiver 120 from the SDAR service provider (162). The SDAR receiver 120 then attempts to establish a communication link with its associated slave receivers (164). The master/slave control subsystem 154 assigns an authorized status to the SDAR receiver 120, which performs as an authorized receiver (166) having access to a full set of SDAR services. The SDAR receiver 120 then continues to attempt establishing communication links with other associated slave receivers. If no additional slave receivers are detected, the SDAR receiver 120 simply continues to perform as an authorized receiver (168).

If the SDAR receiver 120 is a slave receiver, the master/slave control subsystem 154 determines whether the SDAR receiver 120 is currently authorized (170). If the SDAR receiver 120 is currently authorized, it performs as an authorized receiver (172). If the SDAR receiver 120 is not currently authorized, the SDAR receiver 120 attempts to establish a communication link with its associated master receiver (174). The master/slave control subsystem 154 then determines whether the proximity criteria specified by the SDAR service provider are satisfied (176). The proximity criteria are satisfied when the SDAR receiver 120 is within the threshold proximity to its associated master receiver, e.g., if the SDAR receiver 120 is within the wireless communication range of its associated master receiver. The proximity criteria may also be satisfied even if the SDAR receiver 120 is not currently within the threshold proximity, as long as it has not been outside the threshold proximity for longer than a threshold duration.

The duration for which the SDAR receiver 120 is outside the threshold proximity may be measured, for example, using a countdown timer. If the SDAR receiver 120 leaves the threshold proximity to the master receiver, the countdown timer may be started. If the SDAR receiver 120 enters the threshold proximity to the master receiver, the countdown timer may be stopped and reset. If the countdown timer expires without being stopped and reset, it can be inferred that the secondary receiver was outside the threshold proximity to the master receiver for longer than the threshold duration.

If the proximity criteria are satisfied, the master/slave control subsystem 154 assigns the authorized status to the SDAR receiver 120. The SDAR receiver 120 then performs as an authorized device (172). On the other hand, if the proximity criteria are not satisfied, i.e., if the SDAR receiver is outside the threshold proximity for longer than the threshold duration, the master/slave control subsystem 154 assigns an unauthorized status to the SDAR receiver 120. The SDAR receiver 120 then performs as an unauthorized device (178) with access to at most a limited subset of SDAR services, such as text messaging.

As demonstrated by the foregoing discussion, various embodiments of the present invention may provide certain advantages. Authorizing a secondary communication device to receive SDAR services based on proximity to a primary communication device facilitates offering multiple subscriptions on a single subscriber account. Further, requiring any secondary communication devices to periodically confirm that they are still within the threshold proximity to the primary communication device to remain authorized may decrease the likelihood of abuse. In particular, this requirement may help ensure that multiple communication devices subscribed under a single subscriber account are in fact being used within a single family or household.

It will be understood by those who practice the invention and those skilled in the art that various modifications and improvements may be made to the invention without departing from the spirit and scope of the disclosed embodiments. The scope of protection afforded is to be determined solely by the claims and by the breadth of interpretation allowed by law.

What is claimed is:

1. A method to enable a secondary communication device to receive communication services, the method comprising:

configuring a primary communication device to receive communication services from a service provider and communicate with the secondary communication device;

configuring the secondary communication device to receive communication services from the service provider when an authorized operational mode is set, prevent receiving communication services when an unauthorized operational mode is set, and communicate with the primary communication device;

determining whether the secondary communication device is within a threshold proximity to the primary communication device;

setting the authorized operational mode for a threshold duration when the secondary communication device is within the threshold proximity to the primary communication device; and setting the unauthorized operational mode when the secondary communication device is outside the threshold proximity to the primary communication device for greater than the threshold duration.

2. The method of claim 1, further comprising establishing a communication link between the primary communication device and the secondary communication device.

3. The method of claim 2, wherein the communication link comprises at least one of a wireless communication link and a wired communication link.

4. The method of claim 3, wherein the wireless communication link is established according to a protocol selected from the group consisting of the Bluetooth, ZigBee, ultra wideband (UWB), IEEE 802.11a, IEEE 802.11b, IEEE 802.11g, IEEE 802.16, and IEEE 802.20 communication protocols.

5. The method of claim 2, further comprising confirming at prescribed time intervals that the secondary communication device is within the threshold proximity to the primary communication device.

6. The method of claim 1, further comprising using the primary communication device to store authorization information using a removable memory device.

7. The method of claim 6, further comprising using the secondary communication device to retrieve the authorization information from the removable memory device.

8. The method of claim 6, wherein the removable memory device comprises a flash memory device.

9. A method to set an operational mode of a communication device in a satellite-based digital audio radio (SDAR) system, the method comprising:

configuring the communication device to receive communication services from a service provider and communicate with another communication device;

receiving, in the communication device, control information from an SDAR service provider;

assigning to the communication device one of a primary communication device status and a secondary communication device status as a function of the control information, wherein the secondary communication device status allows receiving communication services from the service provider when an authorized operational mode is set and prevents receiving communication services when an unauthorized operational mode is set;

when the primary communication device status is assigned, setting an authorized operational mode; and when the secondary communication device status is assigned, setting the authorized operational mode for a threshold duration when the communication device is within a threshold proximity to a primary communication device, and setting an unauthorized operational mode when the communication device is outside the threshold proximity to the primary communication device for greater than the threshold duration.

10. The method of claim 9, further comprising establishing a wireless communication link between the communication device and another communication device.

11. The method of claim 10, wherein the wireless communication link is established according to a wireless communication protocol selected from the group consisting of the Bluetooth, ZigBee, ultra wideband (UWB), IEEE 802.11a, IEEE 802.11b, IEEE 802.11g, IEEE 802.16, and IEEE 802.20 communication protocols.

12. The method of claim 10, further comprising using the wireless communication link to assign to the communication device one of the primary communication device status and the secondary communication device status.

13. The method of claim 9, further comprising confirming at prescribed time intervals that the communication device is within the threshold proximity to the primary communication device.

14. A processor-readable medium having processor-executable instructions for:

configuring a communication device to a secondary communication device status, wherein the secondary communication device status allows receiving communication services from a service provider when an authorized operational mode is set and prevents receiving communication services when an unauthorized operational mode is set;

determining whether the secondary communication device is within a threshold proximity to the primary communication device;

setting the authorized operational mode for a threshold duration when the secondary communication device is within the threshold proximity to the primary communication device; and setting the unauthorized operational mode when the secondary communication device is outside the threshold proximity to the primary communication device for greater than the threshold duration.

15. The processor-readable medium of claim 14, further having processor-executable instructions for establishing a communication link between the primary communication device and the secondary communication device.

16. The processor-readable medium of claim 15, wherein the communication link comprises at least one of a wireless communication link and a wired communication link.

17. The processor-readable medium of claim 16, further having processor-executable instructions for establishing the wireless communication link according to a protocol selected from the group consisting of the Bluetooth, ZigBee, ultra wideband (UWB), IEEE 802.11a, IEEE 802.11b, IEEE 802.11g, IEEE 802.16, and IEEE 802.20 communication protocols.

18. The processor-readable medium of claim 14, further having processor-executable instructions for confirming at prescribed time intervals that the secondary communication device is within the threshold proximity to the primary communication device.

19. The processor-readable medium of claim 14, further having processor-executable instructions for retrieving authorization information from a removable memory device.

20. A processor-readable medium having processor-executable instructions for:

configuring a communication device to receive communication services from an SDAR service provider and communicate with another communication device;

receiving, in the communication device in a satellite-based digital audio radio (SDAR) system, control information from the SDAR service provider;

assigning to the communication device one of a primary communication device status and a secondary communication device status as a function of the control information, wherein the secondary communication device status allows receiving communication services from the SDAR service provider when an authorized operational mode is set and prevents receiving communication services when an unauthorized operational mode is set;

when the primary communication device status is assigned, setting the authorized operational mode; and when the secondary communication device status is assigned, setting the authorized operational mode for a threshold duration when the communication device is within a threshold proximity to a primary communication device, and setting the unauthorized operational mode when the communication device is outside the threshold proximity to the primary communication device for greater than the threshold duration.

21. The processor-readable medium of claim 20, further having processor-executable instructions for establishing a wireless communication link between the communication device and another communication device.

22. The processor-readable medium of claim 21, further having processor-executable instructions for establishing the wireless communication link according to a wireless communication protocol selected from the group consisting of the Bluetooth, ZigBee, ultra wideband (UWB), IEEE 802.11a, IEEE 802.11b, IEEE 802.11g, IEEE 802.16, and IEEE 802.20 communication protocols.

23. The processor-readable medium of claim 21, further having processor-executable instructions for using the wireless communication link to assign to the communication device one of the primary communication device status and the secondary communication device status.

24. The processor-readable medium of claim 20, further having processor-executable instructions for confirming at prescribed time intervals that the secondary communication device is within the threshold proximity to the primary communication device.

25. A communication device operable in a satellite-based digital audio radio (SDAR) system, the communication device comprising:

an antenna configured to receive a signal from an SDAR service provider;

a decoder subsystem operatively coupled to the antenna and configured to generate a control signal as a function of the received signal; and an authorization subsystem operatively coupled to the antenna and configured to assign to the communication device one of a primary communication device status and a secondary communication device status as a function of the control signal, wherein the secondary communication device status allows receiving communication services from the SDAR service provider when an authorized operational mode is set and prevents receiving communication services when an unauthorized operational mode is set, wherein when the primary communication device status is assigned, set the authorized operational mode, and when the secondary communication device status is assigned, set the authorized operational mode for a threshold duration when the communication device is within a threshold proximity to a primary communication device and set the unauthorized operational mode when the communication device is outside the threshold proximity to the primary communication device for greater than the threshold duration.

26. The communication device of claim 25, wherein the authorization subsystem is further configured to establish a communication link between the communication device and another communication device.

27. The communication device of claim 26, wherein the communication link comprises at least one of a wireless communication link and a wired communication link.

28. The communication device of claim 27, further comprising a wireless communication port operatively coupled to the authorization subsystem and configured to establish the wireless communication link according to a protocol selected from the group consisting of the Bluetooth, ZigBee, ultra wideband (UWB), IEEE 802.11a, IEEE 802.11b, IEEE 802.11g, IEEE 802.16, and IEEE 802.20 communication protocols.

29. The communication device of claim 27, wherein the authorization subsystem is further configured to use the wireless communication link to assign to the communication device one of the primary communication device status and the secondary communication device status.

30. The communication device of claim 26, wherein the authorization subsystem is further configured to confirm at prescribed time intervals that the communication device is within the threshold proximity to the primary communication device.

31. The communication device of claim 25, further comprising a data retrieval subsystem configured to retrieve authorization information from a removable memory device.

32. The communication device of claim 31, wherein the removable memory device comprises a flash memory device.

33. The communication device of claim 25, wherein the decoder subsystem comprises the authorization subsystem.

34. The communication device of claim 25, wherein the authorization subsystem is distinct from and operatively coupled to the decoder subsystem.

* * * * *